US011279997B2

(12) United States Patent
Zhang et al.

(10) Patent No.: US 11,279,997 B2
(45) Date of Patent: Mar. 22, 2022

(54) METHOD OF PREPARING METAL NITRIDE, ELECTROCATALYST WTH THE METAL NITRIDE AND USE THEREOF

(71) Applicant: City University of Hong Kong, Kowloon (HK)

(72) Inventors: Wenjun Zhang, New Territories (HK); Bin Liu, New Territories (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/939,423

(22) Filed: Jul. 27, 2020

(65) Prior Publication Data

US 2022/0025505 A1 Jan. 27, 2022

(51) Int. Cl.
*C23C 8/24* (2006.01)
*C23C 8/80* (2006.01)

(52) U.S. Cl.
CPC . *C23C 8/24* (2013.01); *C23C 8/80* (2013.01)

(58) Field of Classification Search
CPC ..... C23C 8/24; C23C 8/80
See application file for complete search history.

(56) References Cited

U.S. PATENT DOCUMENTS 5,334,264 A * 8/1994 Meletis ..... C23C 8/24 148/222
2013/0006320 A1* 1/2013 Hintz ..... A61N 1/375 607/5

* cited by examiner

*Primary Examiner* — Jessee R Roe
(74) *Attorney, Agent, or Firm* — Renner Kenner Greive Bobak Taylor & Weber

(57) ABSTRACT

A method of preparing a metal nitride includes the steps of: a) subjecting a metal precursor to plasma treatment to form the metal nitride, the metal precursor including a transition metal selected from the group consisting of titanium, cobalt, iron and molybdenum; and b) cooling down the metal nitride after the step a). An electrocatalyst including the metal nitride and a method of conducting water hydrolysis by using an electrocatalyst comprising the metal nitride is also disclosed.

9 Claims, 13 Drawing Sheets
(1 of 13 Drawing Sheet(s) Filed in Color)

METHOD OF PREPARING METAL NITRIDE, ELECTROCATALYST WTH THE METAL NITRIDE AND USE THEREOF

TECHNICAL FIELD

The present invention relates a method of preparing a metal nitride and the metal nitride is particularly a nitride of a transition metal. The invention also relates to an electrocatalyst having said metal nitride and applications of the electrocatalyst.

BACKGROUND OF THE INVENTION

Hydrogen, a clean and sustainable energy vector, is a promising alternative to traditional fossil fuels, and its utilization has significant value for addressing the energy crisis and environmental issues. Among the approaches developed thus far for hydrogen production, water electrolysis has demonstrated its inherent superiority in the views of its low cost and environmental benignity. In water electrolysis, electrocatalysts play a predominant role in achieving a high energy conversion efficiency in hydrogen evolution reaction (HER). However, the currently available catalysts for HER are restricted to noble-metal (such as Pt) based materials, and the high cost and scarcity of these materials largely hamper their widespread applications.

Accordingly, there remains a need for developing a new approach to synthesize catalysts in a cost-effective manner particularly using a non-noble metal. The synthesized catalyst as well as the application thereof can provide a useful alternative to the trade and public.

SUMMARY OF THE INVENTION

In one aspect of the present invention, there is provided a method of preparing a metal nitride, the method comprising steps of:

a) subjecting a metal substrate to plasma treatment to form the metal nitride on at least a part of its surface, the metal substrate comprises a transition metal selected from the group consisting of titanium, cobalt, iron, molybdenum, copper and manganese; and
b) cooling down and obtaining a product comprising or consisting of the metal nitride.

In an embodiment, the plasma treatment in the step a) is conducted at a temperature of more than 200° C.

In an embodiment, the plasma treatment in the step a) is conducted in the presence of a plasma produced from nitrogen gas, hydrogen gas or a combination thereof.

In an embodiment, the plasma treatment in the step a) is conducted for less than 24 hours.

In an embodiment, the metal substrate is a metal sheet or a metal foam.

Preferably, the metal nitride is $Co_2N$, $Co_3N$, $Co_4N$, $Fe_2N$, $Fe_3N$, TiN, $Ti_2N$, MoN or $Mo_2N$. In particular, the metal nitride is $Co_4N$, $Fe_3N$, or $Ti_2N$.

In an embodiment, the metal substrate is a metal current collector.

In an embodiment, the method further comprises a step of washing the metal substrate with at least one solvent to remove impurities on its surface, prior to the step a). The metal substrate may be washed with acetone, an alcohol and water sequentially. The alcohol may be selected from the group consisting of methanol, ethanol, propanol, butanol, or a mixture thereof.

In another aspect of the present invention, there is provided an electrocatalyst comprising a metal nitride prepared according to the method above.

Preferably, the metal nitride is selected from $Co_2N$, $Co_3N$, $Co_4N$, $Fe_2N$, $Fe_3N$, TiN, $Ti_2N$, MoN or $Mo_2N$. In particular, the metal nitride is $Co_4N$, $Fe_3N$, or $Ti_2N$.

In an embodiment, the electrocatalyst is configured to be used in water hydrolysis.

In a further aspect of the present invention, there is provided a method of conducting water hydrolysis by using an electrocatalyst, the electrocatalyst comprising said metal nitride prepared according to the above method.

Preferably, the metal nitride is selected from $Co_2N$, $Co_3N$, $Co_4N$, $Fe_2N$, $Fe_3N$, TiN, $Ti_2N$, MoN or $Mo_2N$. In particular, the metal nitride is $Co_4N$, $Fe_3N$, or $Ti_2N$.

One objective of the present invention is to provide a cost-effective and environmentally friendly method for synthesizing a metal nitride which may be suitable to be configured as an electrocatalyst performing catalytic reaction in water hydrolysis. The method takes less than 24 hours, and no additional chemical is required during the synthesis, except the one or more solvents used to clean the metal substrate before the plasma treatment. Given that the metal substrate contains a non-noble metal instead of a noble metal, the manufacturing cost of the metal nitride is thus significantly reduced. The preparation process is also suitable for mass production of the metal nitride.

Further, the metal nitride is suitable to be configured as an electrocatalyst or form a part of the electrocatalyst. The electrocatalyst can be applied in water hydrolysis for splitting water molecules thereby generating hydrogen gas. In an embodiment, the electrocatalyst has enriched nitrogen vacancies thereby enhancing adsorption of water molecules thereon.

Those skilled in the art will appreciate that the invention described herein is susceptible to variations and modifications other than those specifically described. The invention includes all such variations and modifications. The invention also includes all steps and features referred to or indicated in the specification, individually or collectively, and any and all combinations of the steps or features.

Other features and aspects of the invention will become apparent by consideration of the following detailed description and accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE EMBODIMENTS

Figure 1:
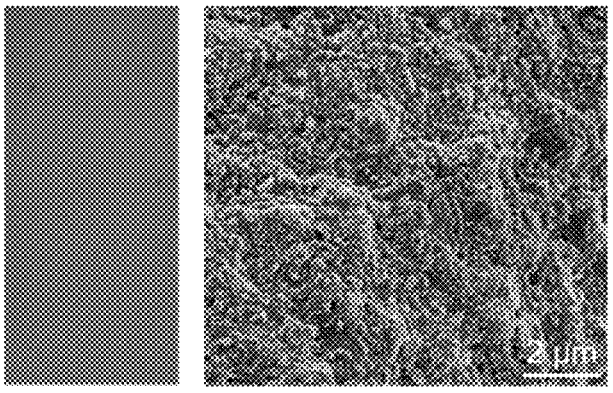
FIG. 1 is a SEM image showing $Co_4N$ particles prepared by using a cobalt foil according to an embodiment of the present invention.

Unless otherwise defined, all technical terms used herein have the same meaning as commonly understood by one skilled in the art to which the invention belongs.

As used herein, "comprising" means including the following elements but not excluding others. "Essentially consisting of" means that the material consists of the respective element along with usually and unavoidable impurities such as side products and components usually resulting from the respective preparation or method for obtaining the material such as traces of further components or solvents. "Consisting of" means that the material solely consists of, i.e. is formed by the respective element. As used herein, the forms "a," "an," and "the," are intended to include the singular and plural forms unless the context clearly indicates otherwise.

The present invention in an aspect provides a method of preparing a metal nitride in particular a nitride of a non-noble metal. The "non-noble metal" herein refers to a metal or an alloy that is devoid of silver, gold, iridium, osmium, palladium, rhodium, ruthenium, and platinum and is generally more abundant and cheaper than the noble metals as listed above. Preferably, the non-noble metal may be a transition metal and is selected from the Groups 4 to 11 of the periodic table. In particular, the transition metal is selected from the group consisting of nickel (Ni), cobalt (Co), titanium (Ti), iron (Fe), molybdenum (Mo), copper (Cu), and manganese (Mn). In an embodiment, the transition metal is Ni, Co, Ti, Fe or Mo, and in particular Co, Ti, or Fe.

The metal nitride is preferably a non-noble metal nitride and has a formula of $M_nN_q$ where M being a non-noble metal, as described above, and N being nitrogen, n being an integer selected from 1 to 4 and q is an integer selected from 1 to 4. Preferably, q is 1. The metal nitride may be $Ni_3N$, $Ni_4N$, CoN, $Co_2N$, $Co_4N$, $Fe_2N$, $Fe_3N$, TiN, $Ti_2N$, MoN, or $Mo_2N$. In an embodiment, the metal nitride may be $Co_4N$, $Fe_3N$, TiN, $Ti_2N$, or $Mo_2N$.

In an alternative embodiment, q of the metal nitride may be 1, less than 1 or of 1−x where x being the quantity of the nitrogen vacancies. For instance, the metal nitride may be $Ni_3N_{1-x}$.

The metal nitride prepared according to the method herein is found to be able to increase the surface area of a metal substrate and/or has increased nitrogen vacancies which can facilitate adsorption of water molecules on the surface of the metal nitride.

The method of the present invention makes use of plasma treatment to prepare a metal nitride using a metal substrate. In particular, the method includes steps of:

a) subjecting a metal substrate to plasma treatment to form the metal nitride on at least a part of its surface, the metal substrate comprises a transition metal selected from the group consisting of titanium, cobalt, iron and molybdenum; and b) cooling down and obtaining a product having the metal nitride.

The "metal substrate" used herein refers to any substance containing a metal or an alloy with a surface which is capable of reacting with the reactive species generated by the plasma in the reaction chamber, thereby forming the metal nitride on at least a part of its surface, or any surface exposed to the plasma during plasma treatment. The metal substrate is preferably a non-noble metal substance that can react and form the corresponding nitride during plasma treatment. For example, when the metal nitride is a transition metal nitride, the metal substrate comprises or consists of the corresponding transition metal. Preferably, the metal substrate comprises a transition metal selected from the group consisting of nickel (Ni), cobalt (Co), titanium (Ti), iron (Fe), molybdenum (Mo), copper (Cu), and manganese (Mn). The metal substrate may be provided in the form of a sheet, a foam or other structure depending on the practical need. In a particular embodiment, the metal substrate is a metal foam having substantial surface area for interacting with the reactive species during the plasma treatment.

In an embodiment, the metal substrate is also a metal current collector which plays an important role in an electrochemical reaction. The metal substrate may be a part of an electrode, or the electrode per se. In an embodiment where the metal substrate is an electrode taking part in a hydrolysis reaction, the metal nitride formed or integrally formed on its surface can directly facilitate the catalytic reaction.

In an embodiment where the metal substrate is a cobalt substrate such as a cobalt foam or cobalt foil, the resulting metal nitride is $Co_2N$, $Co_3N$, $Co_4N$, and in particular $Co_4N$. In another embodiment where the metal substrate is an iron foam or an iron sheet, the resulting metal nitride is $Fe_2N$, $Fe_3N$, and in particular $Fe_3N$. In yet another embodiment where the metal nitride is a titanium foil or a titanium foam, the resulting metal nitride is TiN, $Ti_2N$, and in particular $Ti_2N$. In a further embodiment where the metal substrate is a molybdenum foil or a molybdenum foam, the resulting metal nitride is MoN or $Mo_2N$. In a particular embodiment where the metal substrate is nickel foil or nickel form, the resulting metal nitride is $Ni_3N$, $Ni_4N$, and in particular is $Ni_3N$.

Turning to the method, in the step a), the plasma treatment is preferably conducted under a plasma enhanced chemical vapor deposition (abbreviated as MPECVD) system so as to produce the metal nitride on at least a part of the metal substrate. The plasma treatment may be performed in a microwave MPECVS system with a source of nitrogen gas, a source of hydrogen gas or both of them, i.e. the plasma treatment is conducted in the presence of a plasma produced from nitrogen gas, hydrogen gas or a combination thereof.

The plasma of nitrogen, hydrogen or a combination of the two may be produced by using a microwave power of from about 400 W to about 800 W, from about 500 to about 800 W, about 450 W, about 500 W, about 550 W, about 600 W, about 650 W, about 700 W, about 750 W, or about 800 W. The pressure of the system is from about 10 Torr to about 50 Torr, or from about 10 Torr to about 30 Torr. In an embodiment, the plasma treatment is conducted at a pressure of 14 Torr, or 30 Torr.

The nitrogen gas is supplied at a flow rate from about 10 sccm to about 50 sccm, about 10 sccm, about 20 sccm, about 30 sccm, about 40 sccm or about 50 sccm. The hydrogen gas is supplied, if applicable, at a flow rate from about 10 sccm to about 30 sccm, about 10 sccm, 20 sccm or 30 sccm. The hydrogen gas may be supplied along with the nitrogen gas, for example when the metal substrate comprises iron or titanium.

Preferably, the plasma treatment is conducted at a temperature of more than 200° C., particularly from about 200° C. to 800° C. to heat the substrate to the optimal temperature for reaction with the active species in the plasma. The plasma treatment may be conducted at a temperature of from about 200° C. to 800° C., about 250° C., about 300° C., about 350° C., about 400° C., about 450° C., about 500° C., about 550° C., about 600° C., about 650° C., about 700° C., about 750° C., or about 800° C.

The plasma treatment preferably lasts for less than 24 hours. In particular, the plasma treatment is conducted for about 30 seconds to about 15 hour, about 1 hour to about 10 hours, or about 5 hours. Alternatively, the plasma treatment is conducted for about or less than 20 hours, about or less than 15 hours, about or less than 10 hours, about or less than 5 hours, about or less than 1 hour, about or less than 30 min, about or less than 15 min, about or less than 5 min, about or less than 1 minute, or about or less than 30 seconds.

The rich energetic ions and excited neutral particles in the plasma allow a quick synthesis of the metal nitride without the use of any additional chemical in the reaction system or reaction chamber. Therefore, the entire process is environmentally friendly by consuming less or no toxic chemicals.

Prior to the step a), the method may further comprise a step of washing the metal substrate with at least one solvent to remove impurities on its surface. In an embodiment, the metal substrate is subjected to sonication particularly ultrasonication with one or more solvents so as to remove any undesirable debris or contaminants on its surface, thereby minimizing undesirable side products produced during the plasma treatment, and enhancing the metal nitride formation on the surface of the metal substrate. In an alternative embodiment, the metal substrate may be rinsed with or immersed in to a pool of a solvent for the same purpose. The solvent is preferably a water-miscible solvent.

The washing step may utilize more than one solvent. The metal substrate may be thoroughly washed with acetone, an alcohol, water or a combination thereof under sonication. The alcohol may be selected from the group consisting of methanol, ethanol, propanol, butanol, or a mixture thereof, particularly ethanol. The water may be selected from deionized water, reverse osmosis water, or distilled water, and preferably deionized water. In an embodiment, the metal substrate is washed with acetone, ethanol and deionized water sequentially. The metal substrate may be immersed in acetone for about 10 minutes to 1 hour, ethanol for about 10 minutes to 1 hour, and followed by deionized water for another 10 minutes to 1 hour.

After washing, the metal substrate is dried through natural drying, blowing, or drying with pressurized gas such as nitrogen gas, before subjecting it to the plasma treatment.

The method may further comprise a step of modifying the surface of the metal substrate prior to plasma treatment. It is advantageous to increase the surface area of the metal substrate which may help to form nanostructures of the metal nitride on its surface. For example, the metal substrate may be etched by an acid or an etching chemical to create patterns on the surface. The acid may be hydrochloric acid, nitric acid, or sulfuric acid, and the etching chemical may be ferric chloride or copper sulfate. This modification step may be conducted before the washing step as described above. If it is conducted after the washing step, then the etched metal substrate needs to be thoroughly cleaned again prior to plasma treatment step to avoid undesirable chemical reactions in the reaction system/chamber.

It is found that the method herein allows formation of metal nitrides on at least a part of the surface of the metal substrate. The formed metal nitrides can be in the form of a nanostructure, e.g. as nanoparticles adhered strongly or integrally form on the metal substrate. The formation of the metal nitrides enhances the surface area of the metal substrate and provides active sites for catalytic reaction in particular during water hydrolysis. The inventors also found that nickel nitrides prepared according to an embodiment has superior water adsorption ability, with better wettability, and promotes hydrogen evolution reaction activity.

The present invention also pertains to an electrocatalyst comprising or consisting of a metal nitride prepared according to the method as described above. The electrocatalyst may include one or more transition metal nitrides. In particular, the electrocatalyst is configured to be used in water hydrolysis. The metal nitride is arranged to be exposed to the medium during water hydrolysis and therefore it would be appreciated that the metal nitride may be provided as a coating on the electrode, or as an uttermost layer of the electrode.

Preferably, the electrocatalyst includes or consists of $Ni_3N$, $Ni_4N$, CoN, $Co_2N$, $Co_4N$, $Fe_2N$, $Fe_3N$, TiN, $Ti_2N$, MoN, $Mo_2N$ or a combination thereof. In an embodiment, the electrocatalyst includes or consists of $Ni_3N$. In another embodiment, the electrocatalyst includes or consists of $Co_4N$, $Fe_3N$, TiN, $Ti_2N$, $Mo_2N$ or a combination thereof.

Accordingly, the present invention further provides a method of conducting water hydrolysis by using an electrocatalyst as described above. In particular, the electrocatalyst comprising or consisting of a metal nitride prepared according to the method as described above.

The electrocatalyst prepared according to the present invention is suitable for water electrolysis industry and also hydrogen fuel cell vehicle development. For instance, the electrocatalyst can be applied to assist the production of hydrogen gas for supplying power to an electric car.

The examples set out below further illustrate the present invention. The preferred embodiments described above as well as examples given below represent preferred or exemplary embodiments and a skilled person will understand that the reference to those embodiments or examples is not intended to be limiting.

EXAMPLES

Preparation of Cobalt Nitride $Co_4N$

A piece of cobalt foil was subjected to plasmas treatment using nitrogen plasma initiated by microwave at a pressure of 30 Torr. The flow rate of the nitrogen gas is 20 sccm. The microwave power was 500 W, the substrate temperature was maintained at 500° C., and the duration for plasma treatment was 800 s. As shown in FIG. 1, many $Co_4N$ particles were formed on the substrate after treatment.

Preparation of Iron Nitride $Fe_3N$

Figure 2:
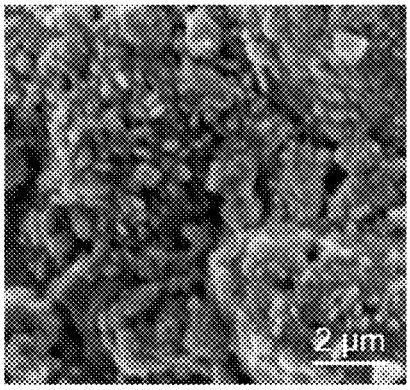
FIG. 2 is a SEM image showing $Fe_3N$ particles prepared by using an iron foil according to an embodiment of the present invention.

A piece of iron foil was subjected to plasmas treatment using nitrogen and hydrogen plasma initiated by microwave at a pressure of 30 Torr. The flow rate of the nitrogen gas is 20 sccm and the flow rate of hydrogen is 10 sccm. The microwave power was 600 W, the substrate temperature was maintained at 500° C., and the duration for plasma treatment was 600 s. As shown in FIG. 2, $Fe_3N$ particles were formed on the substrate after treatment.

Preparation of Titanium Nitride $Ti_2N$

Figure 3:
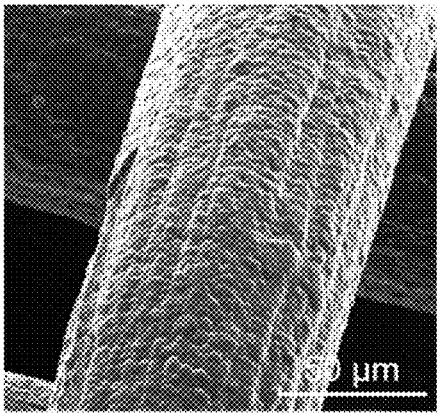
FIG. 3 is a SEM image showing $Ti_2N$ particles prepared by using a titanium foil according to an embodiment of the present invention.

A piece of titanium foil was subjected to plasmas treatment using nitrogen and hydrogen plasma initiated by microwave at a pressure of 30 Torr. The flow rate of the nitrogen gas is 50 sccm and the flow rate of hydrogen is 10 sccm. The microwave power was 800 W, the substrate temperature was maintained at 800° C., and the duration for plasma treatment was 600 s. As shown in FIG. 3, $Ti_2N$ particles were formed on the substrate after treatment.

Preparation of Nickel Nitride

Figure 4A:
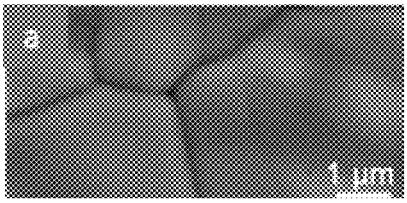
FIG. 4*a* is a SEM image of untreated Ni foam.
Figure 4B:
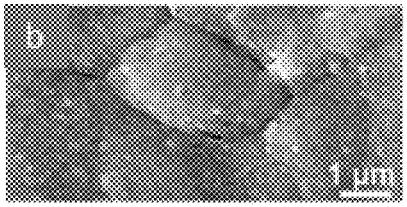
FIG. 4*b* is a SEM image of Ni foam treated at $N_2$ plasma.
Figure 4C:
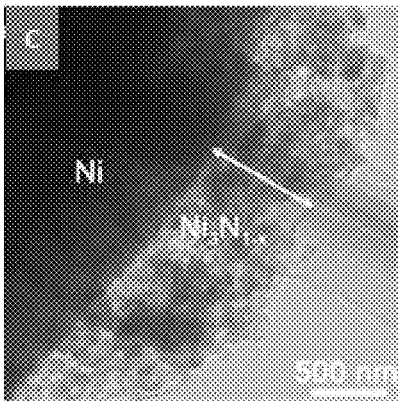
FIG. 4*c* is a TEM image of $Ni_3N_{1-x}$ layer on Ni foam.
Figure 4D:
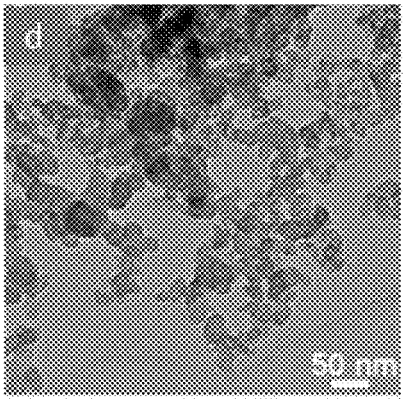
FIG. 4*d* is a TEM image of $Ni_3N_{1-x}$ nanoparticles scratched from Ni foam.
Figure 5:
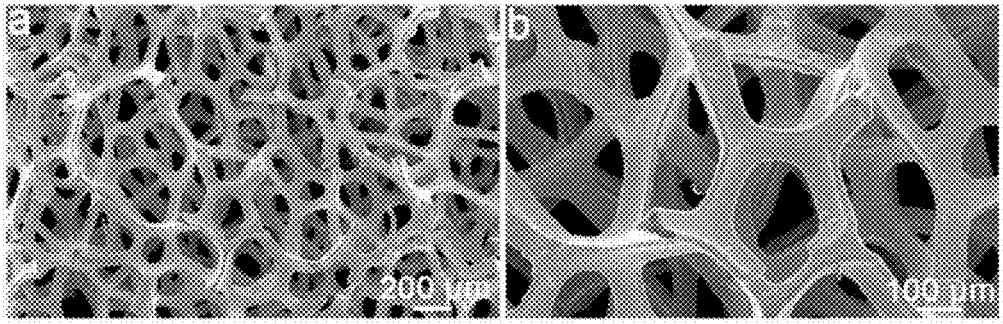
FIG. 5 shows SEM images of a pristine Ni foam.
Figure 6A:
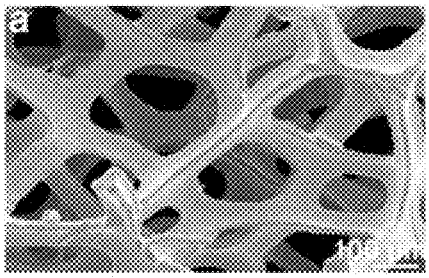
FIGS. 6*a* and 6*b* show low-magnification SEM images (scale bar: 50 μm and 100 μm, respectively)
Figure 6B:
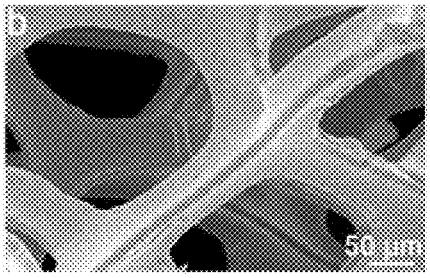
Figure 6C:
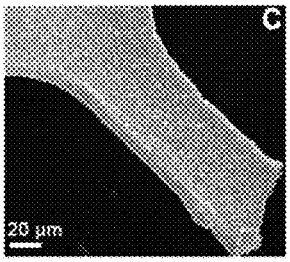
FIGS. 6*c*, 6*d*, and 6*e* show EDX mapping images of the NF after nitrogen plasma treatment at 300° C. for 90 s (scale bar: 20 μm).
Figure 6D:
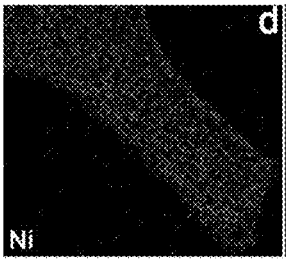
Figure 6E:
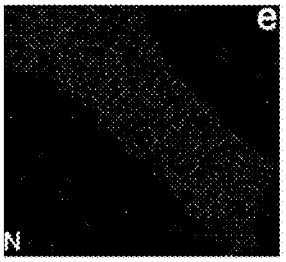

A piece of clean Ni foam was subjected to the nitrogen plasma initiated by microwave for the in-situ growth of nickel nitride nanostructures. The microwave power was 450 W, the substrate temperature was maintained at 300° C., and the duration for plasma treatment was 90 s. The pristine Ni foam had a macroporous structure with the pore size ranging from 100 μm to 400 μm (FIG. 5), and its skeleton had a smooth surface with visible grain boundaries, as shown by the scanning electron microscopy (SEM) image in FIG. 4*a*. After plasma treatment, the color of the Ni foam changed to dark gray; its porous structure still maintained, and energy-dispersive X-ray spectroscopy (EDX) elemental mapping verified that N was uniformly distributed on the NF surface (FIG. 6). The skeleton surface became rough (FIG. 4*b*), and close observation by transmission electron microscopy (TEM) revealed that a low-density layer with a thickness of about 700 nm was formed on Ni foam during plasma treatment (FIG. 4*c*). The layer was identified to be $Ni_3N$ with enriched nitrogen vacancies by the chemical composition characterization as shown below (denoted as $Ni_3N_{1-x}$ hereafter), and the $Ni_3N_{1-x}$ was in nanoparticle configuration with a size of tens of nanometers (FIG. 4*d*).

Figure 4E:
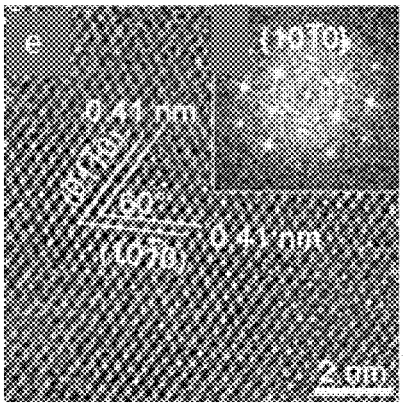
FIG. 4*e* is HRTEM image and FIG. 4*f* is the corresponding FFT pattern of $Ni_3N_{1-x}$.
Figure 4F:
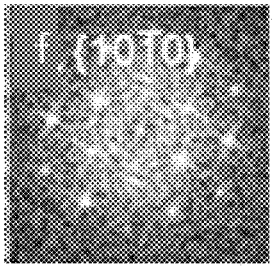

In the high-resolution TEM (HRTEM) image of a nanoparticle in FIG. 4*e*, the denoted lattice fringes with an interplanar spacing of 0.41 nm and an interfacial angle of 60° were indexed to $(10\bar{1}0)$ and $(01\bar{1}0)$ planes of $Ni_3N_{1-x}$, and the corresponding fast Fourier transform (FFT) pattern also agreed with the diffraction pattern along the [0001] zone axis of hexagonal $Ni_3N_{1-x}$ (FIG. 4*f*).

Comparison of the Nickel Nitride Prepared with a Reference

Figure 7:
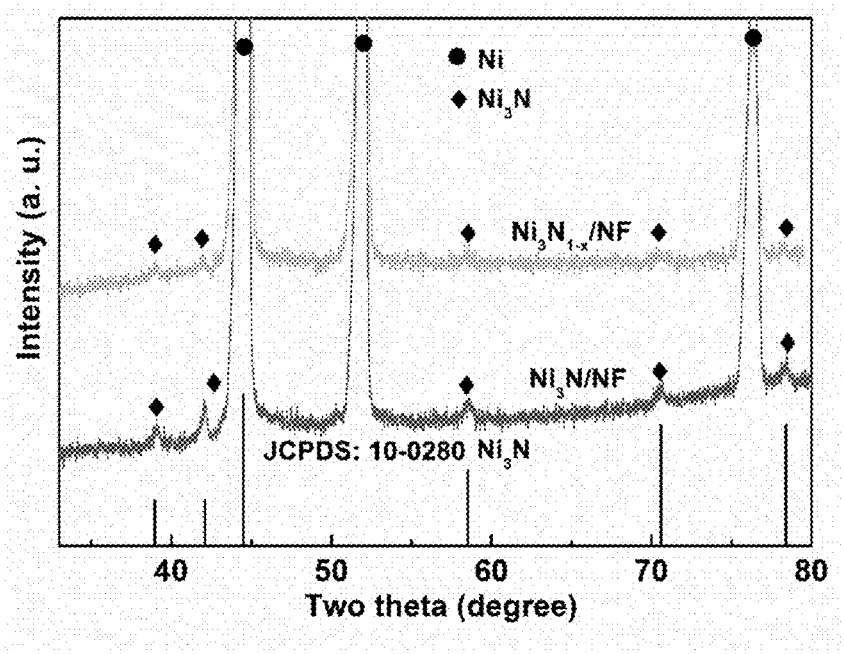
FIG. 7 shows the XRD patterns of $Ni_3N$/NF and $Ni_3N_{1-x}$/NF.
Figure 8A:
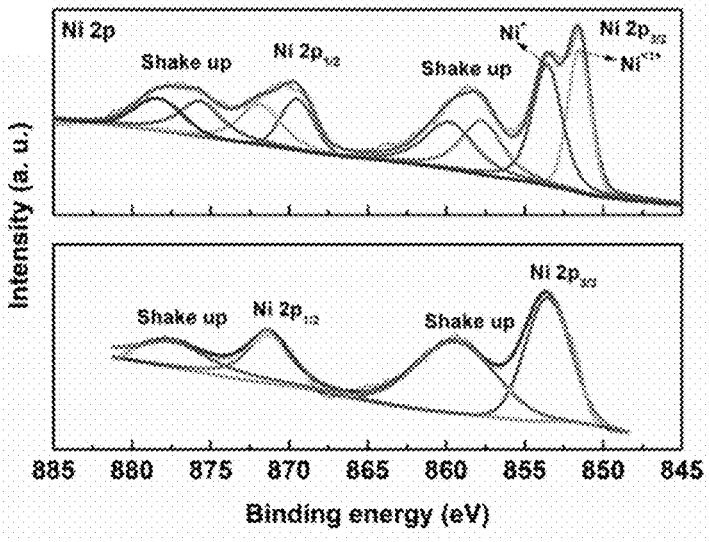
FIG. 8*a* shows the high-resolution XPS spectra of Ni 2p.
Figure 8B:
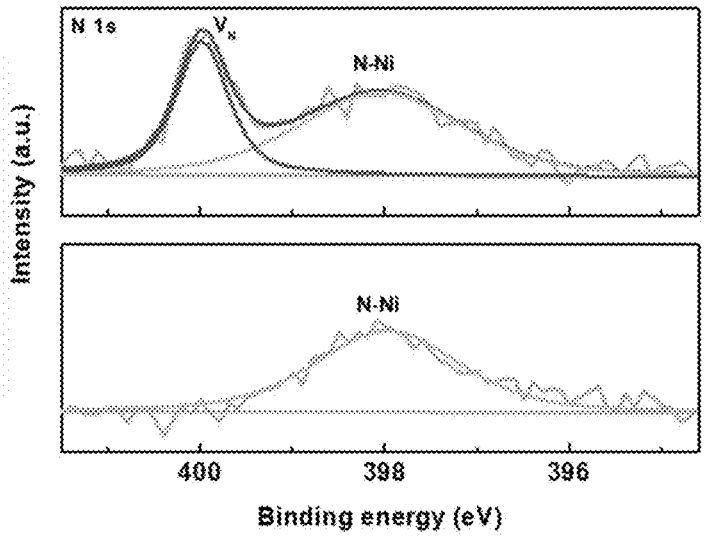
FIG. 8*b* shows the high-resolution XPS spectra of N 1s (top: $Ni_3N_{1-x}$/NF, bottom: $Ni_3N$/NF).

To reveal the difference of the $Ni_3N_{1-x}$ synthesized by plasma-enhanced nitridation, a reference nickel nitride sample was prepared by heating NF in ammonia atmosphere at 450° C. for 1 h (denoted as $Ni_3N$/NF). The X-ray diffraction (XRD) patterns (FIG. 7) verified the formation of hexagonal $Ni_3N$ (JCPDS: 10-0280) in both samples. However, the $Ni_3N_{1-x}$/NF showed weaker and broader diffraction in comparison with the reference sample, indicating a lower crystallinity or a more defective structure of the sample prepared by plasma treatment. X-ray photoelectron spectroscopy (XPS) was further performed to study the chemical composition of the two samples. In the Ni 2p XPS spectra (FIG. 8*a*), two peaks at 853.6 and 871.4 eV for $Ni_3N$/NF were observed, which were assigned to the $2p_{3/2}$ and $2p_{1/2}$ of $Ni^+$, respectively; and the "shake up" satellites were also seen on the higher binding energy side of the main Ni 2p peaks. In comparison, two additional peaks at 851.5 ($2p_{3/2}$) and 869.5 eV ($2p_{1/2}$), which were attributed to the existence of the less valence state of Ni ($Ni^{<1+}$), could be resolved in the Ni 2p XPS spectra of $Ni_3N_{1-x}$/NF. The predominance of $Ni^{<1+}$ in $Ni_3N_{1-x}$/NF suggested the electron density of a considerable fraction of Ni atoms was affected by the existence of nitrogen vacancies. Moreover, the peak at 398.0 eV ascribed to the N—Ni bonding was observed for both $Ni_3N$/NF and $Ni_3N_{1-x}$/NF in the high-resolution N 1s XPS spectra (FIG. 8*b*), and a peak centered at 399.9 eV (denoted as $V_N$) was also revealed for $Ni_3N_{1-x}$/NF. The observation of this extra peak at higher binding energy suggested the reduction of negative charges of nitrogen atoms and further verified the formation of nitrogen vacancies in $Ni_3N_{1-x}$/NF, similar to the variation of XPS signals of oxygen in the oxide nanomaterials with oxygen vacancies. In addition, detailed compositional analysis revealed that the atomic ratio of N:Ni in $Ni_3N$/NF was approximately 1:3.16, which was close to the stoichiometry of $Ni_3N$. By contrast, a significantly smaller atomic ratio of N:Ni (1:5.28) was obtained for $Ni_3N_{1-x}$/NF, which indicated the presence of abundant nitrogen vacancies in $Ni_3N_{1-x}$. All of the above characterizations revealed that the nickel nitride prepared by the microwave-initiated nitrogen plasma treatment had a defective structure enriched with nitrogen vacancies.

Figure 9A:
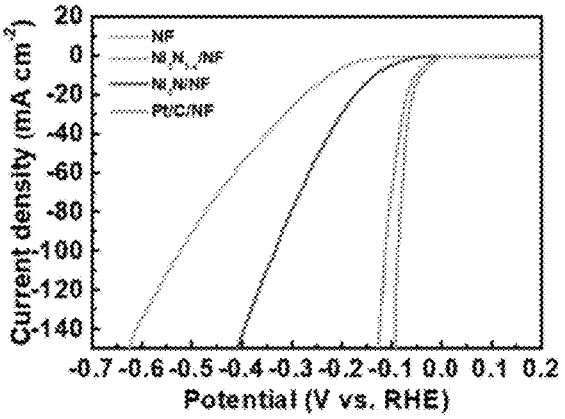
FIG. 9*a* shows the LSV curves of NF, $Ni_3N_{1-x}$/NF, $Ni_3N$/NF and Pt/C/NF measured in 1.0 M KOH solution (pH 14).
Figure 9B:
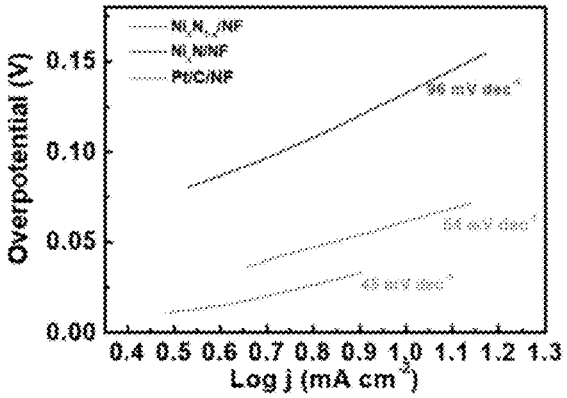
FIG. 9*b* shows the corresponding Tafel plots for the samples.
Figure 9C:
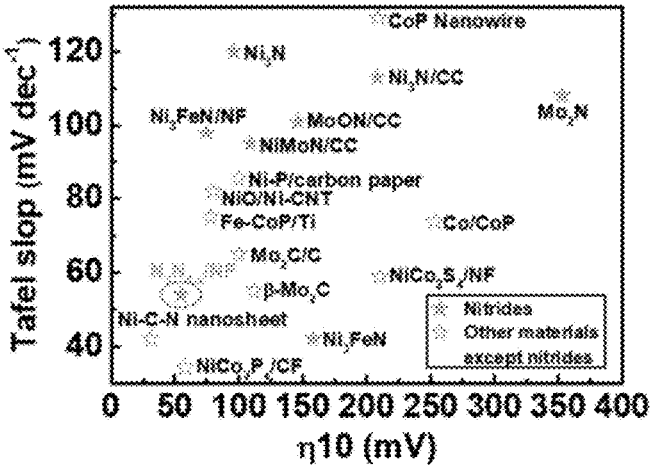
FIG. 9*c* shows the comparison of the performance of $Ni_3N_{1-x}$/NF with the previously reported nitrides and other non-noble metal-based electrocatalysts in basic environment.

The obtained $Ni_3N_{1-x}$/NF was directly utilized as a self-supported cathode for hydrogen generation in a 1.0 M KOH solution (pH 14) using a standard three-electrode configuration. To highlight the superiority of $Ni_3N_{1-x}$/NF, the catalytic performance of bare NF, $Ni_3N$/NF and commercial Pt/C (20 wt % Pt/XC-72) were also evaluated for comparison. FIG. 9*a* presents the linear sweep voltammetry (LSV) curves of all these samples. Among them, Pt/C/NF showed the best HER activity with an overpotential ($\eta_{10}$) of 46 mV at 10 mA $cm^{-2}$. Impressively, $Ni_3N_{1-x}$/NF electrode exhibited an electrocatalytic performance very competitive to that of Pt/C/NF electrode, i.e., an onset potential close to that of commercial Pt/C and an $\eta_{10}$ of 55 mV (only 9 mV higher than that of Pt/C/NF). The mo of $Ni_3N_{1-x}$/NF was substantially reduced as compared with that of $Ni_3N$/NF (140 mV), implying the decisive role of nitrogen vacancies in enhancing the HER activity of nickel nitrides. FIG. 9*b* presents the Tafel slopes of the samples derived from the polarization curves at a slow scan rate of 1 mV $s^{-1}$. $Ni_3N_{1-x}$/NF showed a Tafel slope of 54 mV $dec^{-1}$, which was slightly higher than that of Pt/C/NF (45 mV $dec^{-1}$) but obviously smaller than that of $Ni_3N$/NF (96 mV $dec^{-1}$). Because the Tafel slope is directly associated with the reaction kinetics of electrocatalyst, the lower Tafel slope of $Ni_3Ni_{1-x}$/NF indicates its faster kinetics and superior catalytic activity for HER as compared with $Ni_3N$/NF. As summarized in FIG. 9*c*, $Ni_3N_{1-x}$/NF has actually the lowest $\eta_{10}$ in all nitride-based HER electrocatalysts produced according to ordinary methods in alkaline media, and the overall performance of $Ni_3N_{1-x}$/NF is also excellent in basic electrolytes including hydroxides, sulfides, carbides, phosphides and selenides.

Figure 9D:
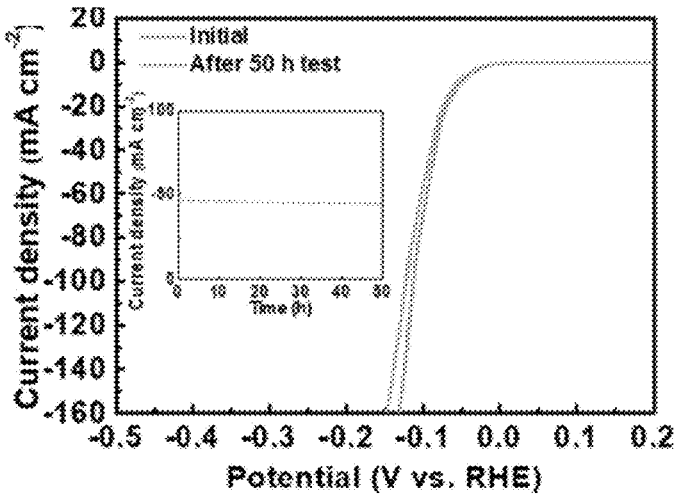
FIG. 9*d* shows the LSV curves before and after stability test for 50 h. The inset is the chronoamperometry curve of $Ni_3N_{1-x}$/NF recorded at an overpotential of 100 mV for a total duration of 50 hours.

Another critical factor to evaluate a HER catalyst is its long-term stability. To explore the durability of $Ni_3N_{1-x}$/NF as a self-supported cathode, a fixed overpotential of 100 mV was applied to $Ni_3N_{1-x}$/NF. As shown in the inset of FIG. 9*d*, the current density maintained almost unchanged during the 50 h's tests. Moreover, the polarization curve recorded after durability test almost overlapped with the initial one before the test, and the overpotential required to achieve current density of 100 mA $cm^{-2}$ merely increased by 6 mV, demonstrating its excellent catalytic stability in basic condition.

Figure 9E:
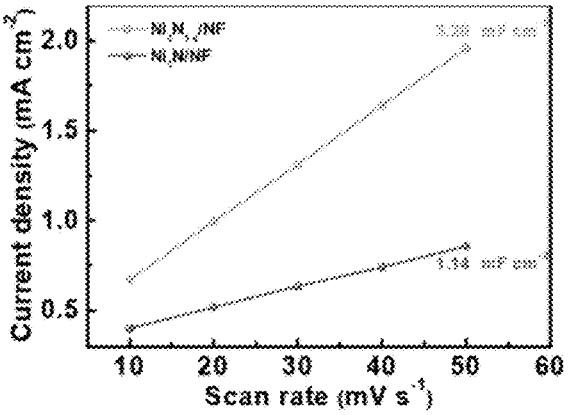
FIG. 9*e* shows the linear fitting of the capacitive currents of the electrodes as a function of scan rates for $Ni_3N_{1-x}$/NF and $Ni_3N$/NF.
Figure 9F:
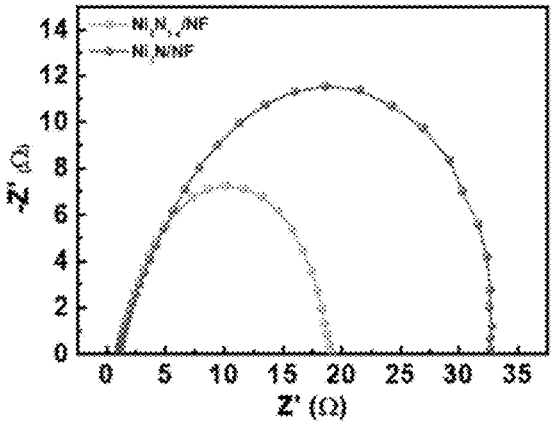
FIG. 9*f* shows the Nyquist plots of $Ni_3N_{1-x}$/NF and $Ni_3N$/NF at an overpotential of 120 mV from 100 KHz to 10 mHz.
Figure 10:
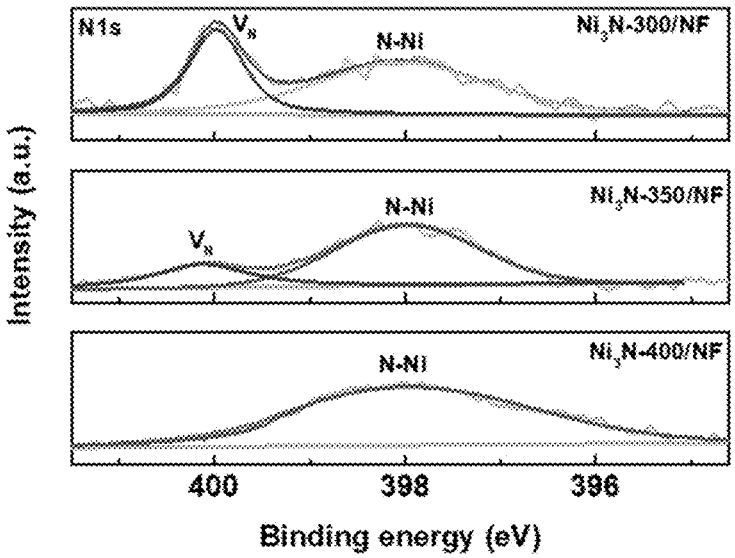
FIG. 10 shows high-resolution N 1s spectra and their deconvolution of $Ni_3N$-300/NF, $Ni_3N$-350/NF and $Ni_3N$-400/NF. $Ni_3N$-300/NF is also denoted as the $Ni_3N_{1-x}$/NF.

To understand the effects of nitrogen vacancies on the superior HER activity of $Ni_3Ni_{1-x}$/NF to that of $Ni_3N$/NF, their electrochemically active surface areas (EASAs) were evaluated by measuring electrochemical double-layer capacitance ($C_{dl}$). As demonstrated in FIG. 9*e*, the $C_{dl}$ of $Ni_3N_{1-x}$/NF (3.20 mF $cm^{-2}$) was almost 3-fold higher than that of the $Ni_3N$/NF (1.14 mF $cm^{-2}$), which indicated that $Ni_3N_{1-x}$/NF had much increased electrochemically active sites. In addition, electrochemical impedance spectroscopy (EIS) was also carried out to study the HER kinetics of $Ni_3N_{1-x}$/NF and $Ni_3N$/NF, as shown in FIG. 9*f*. It was obvious that $Ni_3N_{1-x}$/NF had a much smaller charge transfer resistance ($R_{ct}$) at the interface between the electrode and electrolyte than that of $Ni_3N$/NF (18.1Ω vs. 31.8Ω), illustrating a highly efficient and fast electron transport in the HER process in $Ni_3N_{1-x}$/NF. The results agreed well with the observation of smaller Tafel slope and superior HER kinetics of $Ni_3N_{1-x}$/NF. Electrocatalytic HER is a representative surface reaction, and the surface wettability of an electrocatalyst is directly associated with its capability for the access of electrolyte, the adsorption of water molecules, and the electrocatalytic activity. Also, the water contact angles on $Ni_3N_{1-x}$/NF and $Ni_3N$/NF were measured. The smaller contact angle on $Ni_3N_{1-x}$/NF (91.3° vs. 128.2° for $Ni_3N$/NF, as illustrated in FIG. 10, suggested its better wettability, which would benefit the adsorption of water and the enhancement of HER reaction kinetics of $Ni_3N_{1-x}$/NF.

Figure 11A:
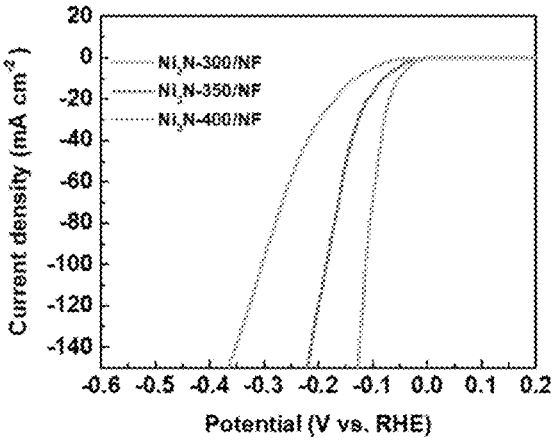
FIG. 11*a* shows the LSV curves of $Ni_3N$-300/NF, $Ni_3N$-350/NF and $Ni_3N$-400/NF measured in 1.0 M KOH solution (pH 14).
Figure 11B:
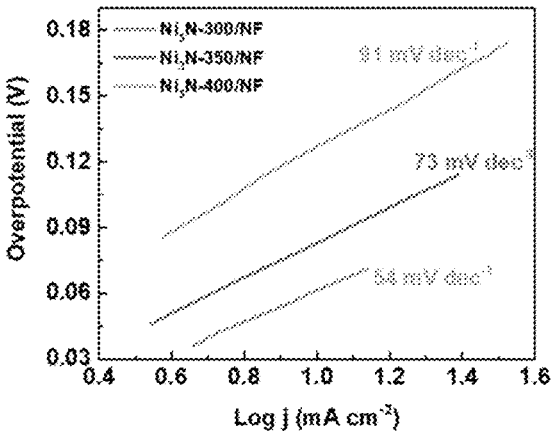
FIG. 11*b* shows the corresponding Tafel plots for the samples.
Figure 12A:
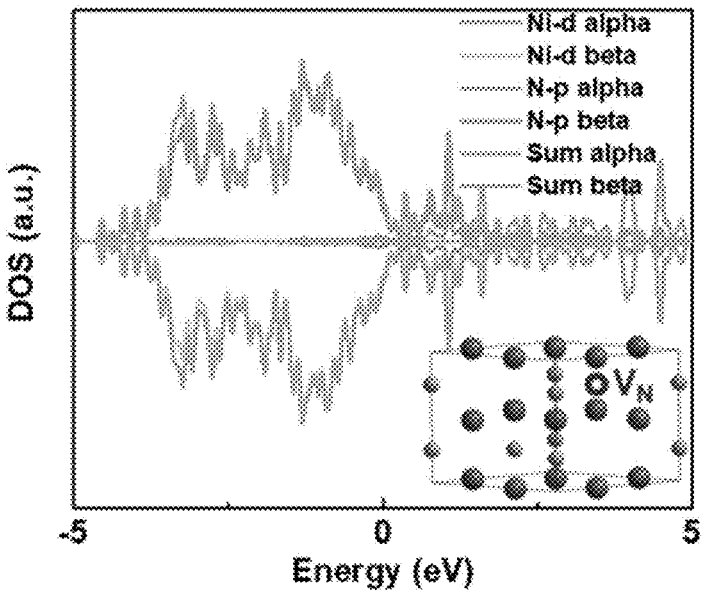
FIG. 12*a* shows the total and partial electronic density of states (TDOS and PDOS) calculated for $Ni_3N_{1-x}$. The Fermi level is set at 0 eV. The inset shows the atomic structure model of $Ni_3N_{1-x}$.
Figure 12B:
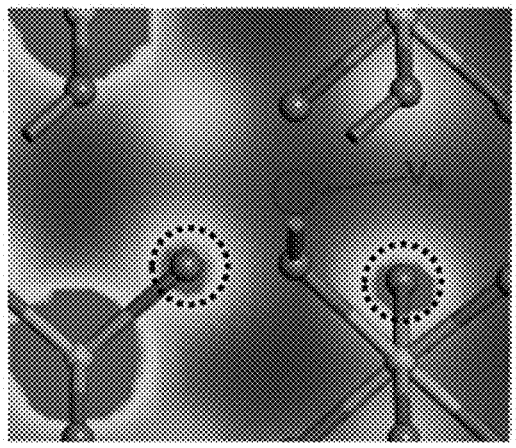
FIG. 12*b* shows the partial charge density distribution of $Ni_3N_{1-x}$.
Figure 13A:
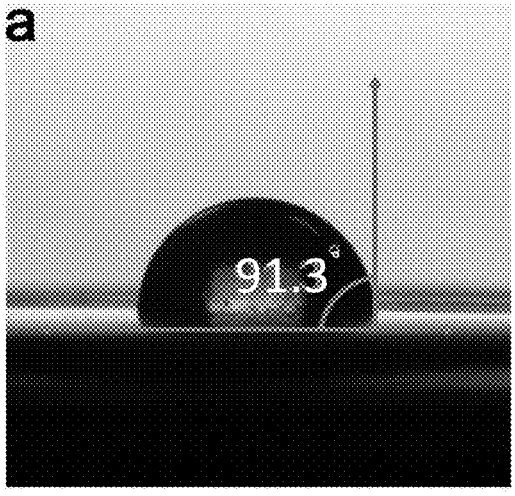
FIG. 13*a* shows the water contact angle measurements for $Ni_3N_{1-x}$/Ni foil and FIG. 13*b* shows the water contact angle measurement for $Ni_3N$/Ni foil, both shown after resting the water droplet on the surface for 4 s.
Figure 13B:
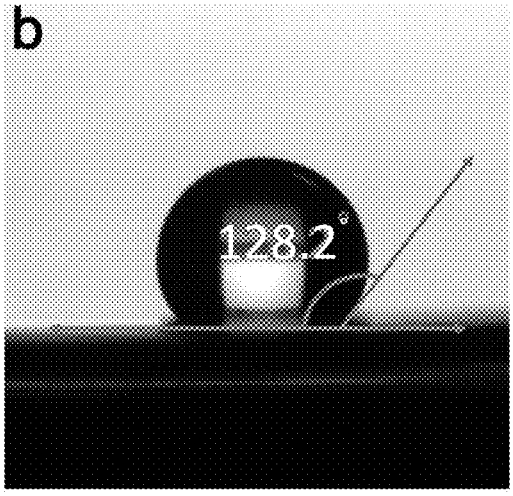

By normalizing the HER current densities with respect to the EASAs, the intrinsic activities of $Ni_3N_{1-x}$/NF and $Ni_3N$/NF were obtained, as depicted in FIG. 11. At a given potential after onset, the current density of $Ni_3N_{1-x}$/NF was considerably higher than that of the $Ni_3N$/NF, implying that $Ni_3N_{1-x}$/NF had a significantly improved intrinsic HER activity. Density functional theory (DFT) simulations were carried out to pinpoint the origin of the enhanced intrinsic activity of $Ni_3N_{1-x}$/NF. As shown in the insert of FIG. 12*a*, $Ni_3N_{1-x}$ is an interstitial compound, in which planes of nickel atoms stack in an ABAB fashion within the unit cell, and nitrogen atoms as interstices atoms occupy the octahedral sites of the nickel lattice in an ordered fashion to minimize the repulsive N—N interactions. With the existence of nitrogen vacancies, a continuous distribution of the density of states (DOS) and a large number of electronic states near the Fermi level were observed (FIG. 4*a*), suggesting that $Ni_3N_{1-x}$ was still in the metallic state with a high electrical conductivity. The results were consistent with the EIS measurements that $Ni_3N_{1-x}$/NF had fast electron transport in the electrocatalytic process. Furthermore, as revealed by the calculated partial charge density distribution in FIG. 12*b* and FIG. 13, the existence of nitrogen vacancy might lead to charge redistribution in $Ni_3N_{1-x}$, in which the electron density around Ni atoms next to the nitrogen vacancy substantially increased. Such a charge redistribution led to the formation of $Ni^{<1+}$, as revealed the XPS measurements.

Figure 12C:
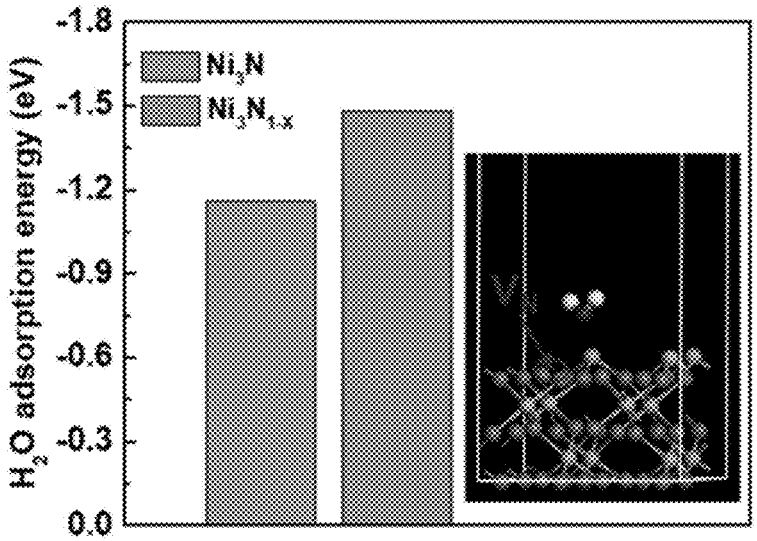
FIG. 12*c* shows the adsorption energies of $H_2O$ molecules on the surfaces of $Ni_3N$ and $Ni_3N_{1-x}$. The insert is a side-view schematic model showing the $Ni_3N_{1-x}$ structure with a $H_2O$ molecule adsorbed on its surface.
Figure 14:
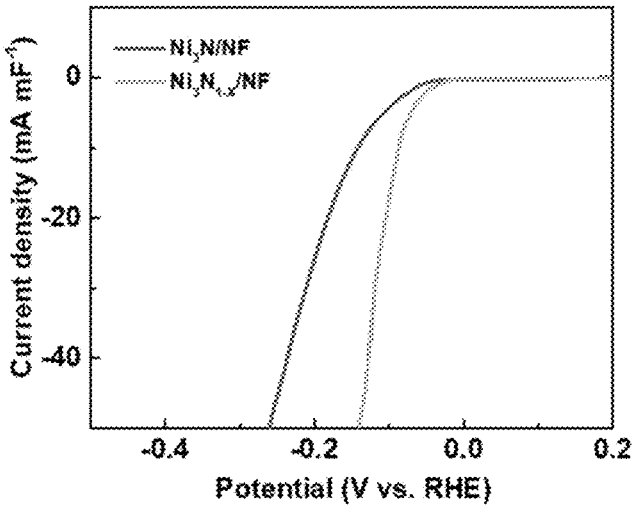
FIG. 14 shows the polarization curves normalized by the electrochemical double-layer capacitance for $Ni_3N$/NF and $Ni_3N_{1-x}$/NF.

For the HER in basic media, two separate pathways (the Volmer-Tafel or the Volmer-Heyrovsky mechanism) have been proposed for reducing H. to $H_2$. Specifically, these two distinct mechanisms involve three principal steps, referring to the Volmer (adsorption and electrochemical reduction of water: $H_2O+e \rightarrow H.+OH^-$), the Heyrovsky (electrochemical desorption: $H.+H_2O+e \rightarrow H_2+OH^-$) and the Tafel (chemical desorption: $H.+H. \rightarrow H_2$) reactions. The Tafel slope of 54 mV $dec^{-1}$ for $Ni_3N_{1-x}$/NF indicates a Volmer-Heyrovsky mechanism of $Ni_3N_{1-x}$ electrode, where the adsorption of $H_2O$ molecules is fundamental in both reactions. Therefore, the adsorption energies of $H_2O$ molecules on the surfaces of $Ni_3N_{1-x}$ and $Ni_3N$ were calculated. The optimized structures of $Ni_3N_{1-x}$ and $Ni_3N$ with $H_2O$ molecules adsorbed on their surfaces are shown in FIG. 12*c* and FIG. 14, respectively. The $Ni_3N_{1-x}$ enriched with nitrogen vacancies possessed an increased adsorption energy (absolute value) as compared with the stoichiometric $Ni_3N$ (1.48 eV vs. 1.15 eV as summarized in FIG. 12*c*), verifying that the presence of nitrogen vacancies could decrease the energy barrier for the adsorption of $H_2O$. As a result, the Volume step and Heyrovsky step could be promoted simultaneously.

Figure 12D:
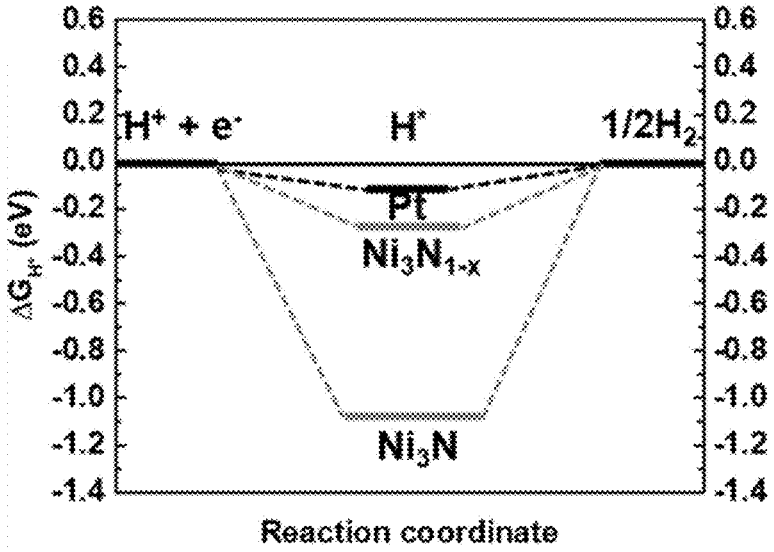
FIG. 12*d* shows the calculated free-energy diagram of HER at the equilibrium potential for $Ni_3N$, $Ni_3N_{1-x}$, and Pt reference. H. denotes that intermediate adsorbed hydrogen.
Figure 15:
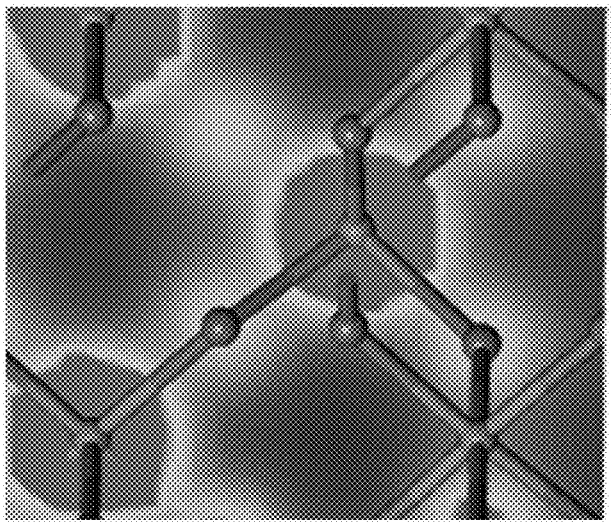
FIG. 15 shows the calculated partial charge density of $Ni_3N$.
Figure 16:
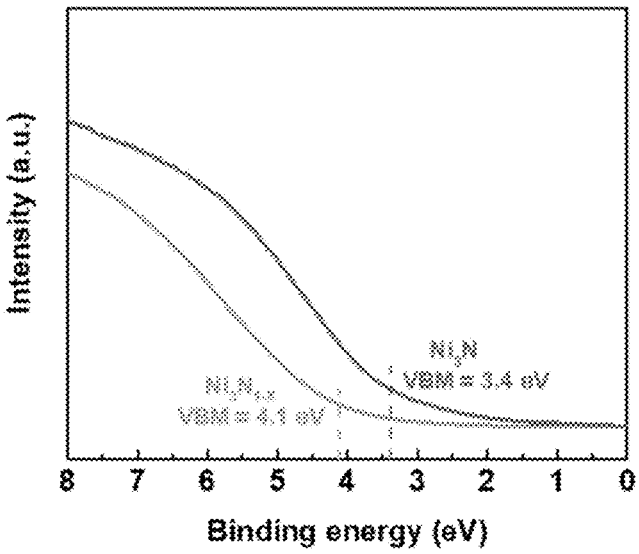
FIG. 16 shows the UPS spectra of valence bands of $Ni_3N_{1-x}$ and $Ni_3N$.

On the other hand, HER activity is also strongly related with the Gibbs free-energy ($|\Delta G_{H.}|$) of the intermediate adsorbed hydrogen, and $|\Delta G_{H.}|$ value is regarded as a descriptor of HER activity for a catalyst, i.e., a smaller $|\Delta G_{H.}|$ enables better activity toward HER, and an optimal HER activity can be achieved at $|\Delta G_{H.}|=0.0$ eV due to the balanced proton reduction rate and the removal of adsorbed hydrogen from the catalyst surface. The inventors also used DFT to calculate the $|\Delta G_{H.}|$ on the surface of $Ni_3N$ with and without nitrogen vacancies, as shown in FIG. 12*d*. It was revealed that $Ni_3N_{1-x}$ had a substantially reduced $|\Delta G_{H.}|$ value (0.28 eV) compared to the $Ni_3N$ (1.05 eV), which illustrated the presence of nitrogen vacancies induced a more favorable adsorption-desorption behavior of intermediately adsorbed hydrogen H. on $Ni_3N_{1-x}$. The theoretical simulations also agreed well with the experimental observations that $Ni_3N_{1-x}$/NF had an obviously improved HER catalytic activity comparable to the $Ni_3N$/NF in basic condition. In addition, the favorable adsorption-desorption behavior of H. initiated by nitrogen vacancies also led to obviously enhanced HER activity of $Ni_3N_{1-x}$/NF in neutral electrolyte. As shown in FIGS. 15 and 16, $Ni_3N_{1-x}$/NF displayed an $\eta_{10}$ of only 89 mV, and a Tafel slope of 63 mV $dec^{-1}$, respectively, with outstanding durability, both of which were much smaller than those of $Ni_3N$/NF without nitrogen vacancies (223 mV, and 106 mV $dec^{-1}$, respectively).

Based on the structural analysis and the theoretical simulation, the outstanding catalytic performance of the $Ni_3N_{1-x}$/NF electrode could be mainly attributed to collective effects of the following aspects: (1) The nitrogen vacancies optimized the electronic structure of $Ni_3N_{1-x}$, which on one hand reduced the energy barrier for the adsorption of $H_2O$ (promoting the Volume step and Heyrovsky step simultaneously), and on the other hand induced balanced adsorption-desorption of intermediate adsorbed hydrogen H. on $Ni_3N_{1-x}$. (2) The intrinsic metallicity of the $Ni_3N_{1-x}$ layer synthesized by plasma nitridation guaranteed the fast charge transfer on the interface between active material and electrolyte during catalytic process. (3) The integrated electrode by growing $Ni_3N_{1-x}$ directly on Ni foam would have its inherent superiority over those fabricated with the nanoparticles, nanowires/nanobelts, and nanosheets using a polymer binder. In this case, the active catalytic material had an improved electron transport with the current collector and avoid shelter of active sites. Moreover, the strong adhesion of $Ni_3N_{1-x}$ layer on Ni foam also benefited its mechanical and catalytic stabilities.

In contrast to the conventional chemical approaches which employed hazardous nitrogen sources (such as azides, hydrazine, cyanamide, and ammonia) to synthesize metal nitrides, the $Ni_3N_{1-x}$ nanostructures were formed through nitridation of commercially available Ni foam in nitrogen plasma generated by microwave. The rich energetic ions and excited neutral particles in the plasma enabled the quick synthesis of nickel nitride without the need of toxic substances. In particular, the plasma-assisted nitridation led to the formation of significant nitrogen vacancies in nickel nitride, which was demonstrated to enhance the adsorption of water molecules (i.e., reducing kinetic energy barriers of the Volmer and Heyrovsky steps) and ameliorate the adsorption-desorption behavior of intermediately adsorbed hydrogen on its surface. Moreover, the intimate contact between the metallic $Ni_3N_{1-x}$ and Ni substrate allowed fast charge transport during HER process. As a result, the $Ni_3N_{1-x}$/NF cathode presented an HER activity comparable to that of Pt/C electrode with an overpotential of 55 mV at 10 mA $cm^{-2}$, and a Tafel slope of 54 mV $dec^{-1}$ achieved in alkaline environment, and the cathode also showed outstanding long-term durability toward HER.

The invention claimed is:

1. A method of preparing a metal nitride, the method comprising steps of:

a) subjecting a metal substrate to plasma treatment to form the metal nitride on at least a part of its surface, the metal substrate comprises a transition metal selected from the group consisting of titanium, cobalt, iron, molybdenum, copper and manganese; and b) cooling down and obtaining a product comprising or consisting of the metal nitride;

wherein the method further comprises a step of washing the metal substrate with at least one solvent to remove impurities on its surface, prior to the step a, wherein the metal substrate is washed with acetone, an alcohol and water sequentially.

2. The method of claim 1, wherein the plasma treatment in the step a) is conducted at a temperature of more than 200° C.

3. The method of claim 1, wherein the plasma treatment in the step a) is conducted in the presence of a plasma produced from nitrogen gas, hydrogen gas or a combination thereof.

4. The method of claim 1, wherein the plasma treatment in the step a) is conducted for less than 24 hours.

5. The method of claim 1, wherein the metal substrate is a metal sheet or a metal foam.

6. The method of claim 1, wherein the metal nitride is $Co_2N$, $Co_3N$, $Co_4N$, $Fe_2N$, $Fe_3N$, TiN, $Ti_2N$, MoN or $Mo_2N$.

7. The method of claim 6, wherein the metal nitride is $Co_4N$, $Fe_3N$, or $Ti_2N$.

8. The method of claim 1, wherein the metal substrate is a metal current collector.

9. The method of claim 1, wherein the alcohol is selected from the group consisting of methanol, ethanol, propanol, butanol, or a mixture thereof.

* * * * *